US007191869B1

(12) United States Patent
Denison

(10) Patent No.: US 7,191,869 B1
(45) Date of Patent: Mar. 20, 2007

(54) SLIDE TO SAFETY EMERGENCY EVACUATION

(76) Inventor: Orville Douglas Denison, 313 Circle Oak Dr., Monrovia, CA (US) 91016

( * ) Notice: Subject to any disclaimer, the term of this patent is extended or adjusted under 35 U.S.C. 154(b) by 0 days.

(21) Appl. No.: 11/306,690

(22) Filed: Jan. 6, 2006

(51) Int. Cl.
*A62B 1/20* (2006.01)

(52) U.S. Cl. ..... 182/49

(58) Field of Classification Search ..... 182/48, 182/49, 137; 244/137.2
See application file for complete search history.

(56) References Cited

U.S. PATENT DOCUMENTS

| | | | | |
|---|---|---|---|---|
| 3,016,975 A | | 1/1962 | Gogol et al. | 182/48 |
| 3,458,009 A | * | 7/1969 | Favors | 182/48 |
| 3,771,749 A | * | 11/1973 | Smialowicz | 244/137.2 |
| 3,838,750 A | | 10/1974 | Williams, Jr. et al. | 182/48 |
| 3,944,021 A | | 3/1976 | Smith, Jr. et al. | 182/3 |
| 4,031,583 A | * | 6/1977 | Phillips, II | 114/362 |
| 4,606,431 A | | 8/1986 | Ruder, Sr. | 182/49 |
| 4,813,663 A | * | 3/1989 | Rice | 472/116 |
| 5,060,753 A | | 10/1991 | Hopkins | 182/48 |
| 5,150,767 A | * | 9/1992 | Miller | 182/137 |
| 5,535,848 A | * | 7/1996 | Giuliano et al. | 182/49 |
| 5,906,340 A | | 5/1999 | Duggal | 244/137.2 |
| 6,877,696 B2 | * | 4/2005 | Moro | 244/137.2 |

FOREIGN PATENT DOCUMENTS

GB 2032366 A * 5/1980

* cited by examiner

*Primary Examiner*—Alvin Chin-Shue
(74) *Attorney, Agent, or Firm*—Louis Ventre, Jr.

(57) ABSTRACT

An inflatable slide to aide in the evacuation of people from multi-storied buildings and a method of using the slide. The slide has three principle elements: an inflatable bag (10); a container (60) for the inflatable bag; and a pressurized gas source (20) to fill and deploy the bag. A deployed bag sits atop the stairs between landings in a stairwell and has a top surface (70) suitable for sliding down the steps. The container (60) stores the inflatable bag when not inflated and releases the bag when the pressurized gas source (20) is activated.

17 Claims, 2 Drawing Sheets

SLIDE TO SAFETY EMERGENCY EVACUATION

FIELD OF INVENTION

In the field of emergency evacuation of multi-story buildings, an inflatable slide deployable on the steps in an emergency exit stairwell of a building and a method of using the slide.

DESCRIPTION OF PRIOR ART

The Slide to Safety Emergency Evacuation is an inflatable slide and method of using the slide to facilitate the evacuation of multi-story buildings in emergencies. Evacuation slides are known, but suffer from various shortcomings solved by the present invention. A significant attribute of the present invention is that is can be quickly and easily implemented by people of all sizes, ages and abilities.

Fires and other building emergencies often involve serious risk of loss of life. Such risks are attributable directly to the emergency incident itself, and may also be attributable to the evacuation or escape by the building occupants from the incident. Multi-story buildings amplify the impediments to fast and efficient evacuation because of the inherent difficulty in safely moving large numbers of people down and out of a building. Walking down multiple flights of stairs in an agitated state multiplies the risk of stumbling, serious injury, delayed escape, or even death.

Sliding systems for building evacuation, which are deployable out of a window, are known. U.S. Pat. No. 3,016,975 to S. Gogol, et al. on Jan. 16, 1962 exemplifies prior art employing a slide external to a building and supported by framing. The '975 patent teaches a retractable slide type escape for use between a window and the ground in a home or other building where it would be practical to have a slide from the window to the ground. This design is functional for two story buildings, but becomes inherently impractical in multi-story buildings because of the height of the slide and the consequent speed an individual would attain when reaching the bottom of the slide.

Unlike the present invention, the slide described in the '975 patent is not inflatable, nor is it deployable inside a building within a stairwell, or structurally supported by stairs.

In the present invention, the sliding distance on each set of stairs between landings is much smaller. This factor breaks up the sliding distance to manageable increments, thereby overcoming user fears and the opportunity for fear induced accidents.

The present invention provides speed-limiting means at the end of each slide segment, being a bottom cushion segment, which is not disclosed in the '975 patent.

The present invention enables multiple persons to exit simultaneously, whereas the '975 patent permits one person at a time to exit.

The present invention is capable of being easily used by persons with disabilities, whereas use of the slide described in the '975 patent would be difficult for people with physical disabilities, suffering from acrophobia or susceptible to vertigo.

The present invention, being deployed inside a building, shields the user from the elements. Inventions like those in the '975 patent subject individuals to the conditions in the outside environment.

The present invention facilitates evacuation of unconscious persons by emergency personnel using gravity. The '975 patent would not be suitable for that purpose as only a single escaping individual will fit on the slide at once and that individual must be capable of controlling his position on the slide to avoid falling off.

Others have described a means for controlled escape from multi-story building using various means located on the external walls of a building. For example, U.S. Pat. No. 3,944,021 to Melvin F. Smith, Jr., et al. on Mar. 16, 1976 is for a fire escape system with a controlled descent designed for use with multi-story buildings.

The '021 patent teaches a generally vertical column attached vertically adjacent to the outside of the building. The column is longitudinally slotted on one side to form a main descent channel and which has mounted within it a series of helical lead screws, which are fitted together to form one continuous worm shaft. Multiple carrier seats (or harnesses) located at the windows are designed to slide, by gravity from windows to the main descent channel and thence down to ground level in a descent controlled by a motor-driven rotating helical screw.

While the '021 has a speed-limiting mechanism, this type of mechanically-driven gravity resistance is inherently different from the present invention. The means for controlling descent in the '021 patent is a helical screw rather than the small increments of gravity assisted descent followed by soft cushioned landings on a stairwell landing.

The '021 patent describes a mechanical device that is always in a deployed state on the building exterior. In contrast, the present invention is deployed only upon action taken in an emergency incident, much like the axe and fire extinguisher in a glass-sealed alcove. The slide of the present invention is compactly stowed in an unobtrusive way within the building emergency evacuation stairwell.

Finally, the '021 patent, like most of this type of prior art, does not use a sliding surface to facilitate escape from a multi-story building.

Inflatable, sliding evacuation systems are known and have been used in large ships and ocean going vessels for passenger escape to life rafts. An example of this is U.S. Pat. No. 4,031,583 to Ronald Wayne Phillips, II, et al. on Jun. 28, 1977, which describes an Inflatable Emergency Equipment Deployment Device. This invention is an inflatable slide designed to be mounted the edge of the deck of a ship. The slide is deployed over the edge of the deck with a system for inflating the slide to a raft on the water below.

The '583 patent teaches a combination stowage and deployment device for emergency evacuation inflatables, which can be used in conjunction with an inflation system to form a neat, compact package. This invention further teaches an emergency evacuation inflatable stowage and deployment device having a fire and/or heat shield. Guy wires support the inflated slide. Tanks supply the air for inflation upon being triggered by the user.

The present invention is significantly different from the '583 technology in that it is deployed over stairs that support the inflated slide; no guy wires or other structural support supplements are required beyond the existing stair structure already present.

Unlike the present invention, the '583 patent does not teach an inflatable slide in stairwell landing segments, but rather describes a single slide segment from ship's deck to the raft.

Unlike the present invention, the '583 patent does not instruct on the provision of incremental descent in a stairwell of multi-story buildings.

Finally, unlike the present invention, the '583 does not disclose a cushioned speed-limiting landing zone to safely stop a person at the end of each slide increment.

Inflatable, sliding evacuation systems are also known and have been used for evacuation of airplanes.

Typical of the airplane application is U.S. Pat. No. 5,906,340 to Virinder Duggal on May 25, 1999 teaches an Inflatable Escape Slide Assembly for use evacuating personnel from an aircraft. The '340 patent teaches a slide having side tubes and multiple cross support tubes along with a slide panel that extends the full length of the slide. A sheet stretched between the side tubes forms the sliding surface. The slide has a head end and a toe end with one of the cross tubes located at the head end defining a head end tube. Pressurized air in tanks provides the means for inflation.

The '340 patent teaches a technology with similar limitations to those discussed above for the '583 patent in a marine application. While these will not be repeated, there are additional distinguishing features. The present invention does not employ a slide with two inflatable side tubes and a sheet between, but rather is inflated across the entire width. Typical of airplane slides, the '340 patent has structural tubes that are required to support the weight of persons sliding down. The present invention has the distinction and advantage of requiring much less structural support and thus much less volume and weight. The volume of the inflatable slide need only be of sufficient volume and structure to provide a cushioning effect on the top of the stairs, which are the structural support for the slide. The present invention provides enough fillable volume and structure to minimize deflection under the weight of the person sliding down, so that a person's rear end does not bump on the tops of the stairs as the person slides down.

Finally, the prior art teaches a non-inflatable slide in multi-story building stairwells. Typical of this application is U.S. Pat. No. 4,606,431 to Fred A. Ruder, Sr. on Aug. 19, 1986, which teaches Evacuation Slides For Multi-Story Buildings. The '431 patent describes a substantially flat elongated slide for each flight of steps in a building stairwell. The slide mounts to the on the wall in the stairwell and swings in place on a flight of stairs when the need arises.

While the '431 patent discloses the use of a slide in a stairwell, it does not teach the use of an inflatable slide as in the present invention. Rather, the technology employed is a substantially flat slide of solid construction. The cushioned effect from an inflatable slide makes the initial access and sliding descent much softer for evacuees. This not only eases the physical forces felt by the evacuee, but it diminishes a psychological fear of self-injury in the sliding process. An inflatable slide is more usable for these reasons, and this improvement serves as means for faster evacuation of a building population.

Unlike the present invention, the '431 patent does not teach integral, speed limiting cushions at the end of each slide. Here again, the softer nature of the sliding process could significantly improve usage and support the evacuation.

Unlike the present invention, the '431 patent does not teach deployment of a single stair segment or all stair segments by simultaneously activating pressurized means. The '431 slide must be rotated in position by physical exertion of the user. The present invention is pneumatically operated with little physical effort required on the part of the user to enable the sliding mechanism.

The present invention enables multiple persons to exit simultaneously, whereas the '431 patent permits one person at a time to slide down to the landing, possibly coming to a disorienting, jarring stop on the hard stair landing. Such disorientation can slow descent and impair use of the slide by another evacuee attempting to slide.

Accordingly, the present invention will serve to improve the prior art by being unobtrusively integrated into a multi-story building; not requiring special skills or physical ability to deploy or utilize it; enabling multiple persons to exit simultaneously; facilitating assisted and unassisted evacuation of persons with disabilities; and, speeding building evacuation in emergency situations.

BRIEF SUMMARY OF THE INVENTION

An inflatable slide building evacuation device and method of using the slide. The preferred embodiment of the slide is integrated into the building stairwell, is composed of slide segments deployable between stairwell landings, is deployed over the steps and includes a speed-limiting cushion at the end of each slide segment. The slide is inflated by a pressurized gas source. The slide may be inflated incrementally, in slide segments, or all at once, either centrally or locally in the stairwell. The slide is structurally supported by the stairs. Once deployed, evacuees of varied ages and physical conditions may slide between the stair landings in the stairwell, thereby exiting a building more quickly and easily than would be possible by walking.

DETAILED DESCRIPTION

Figure 1:
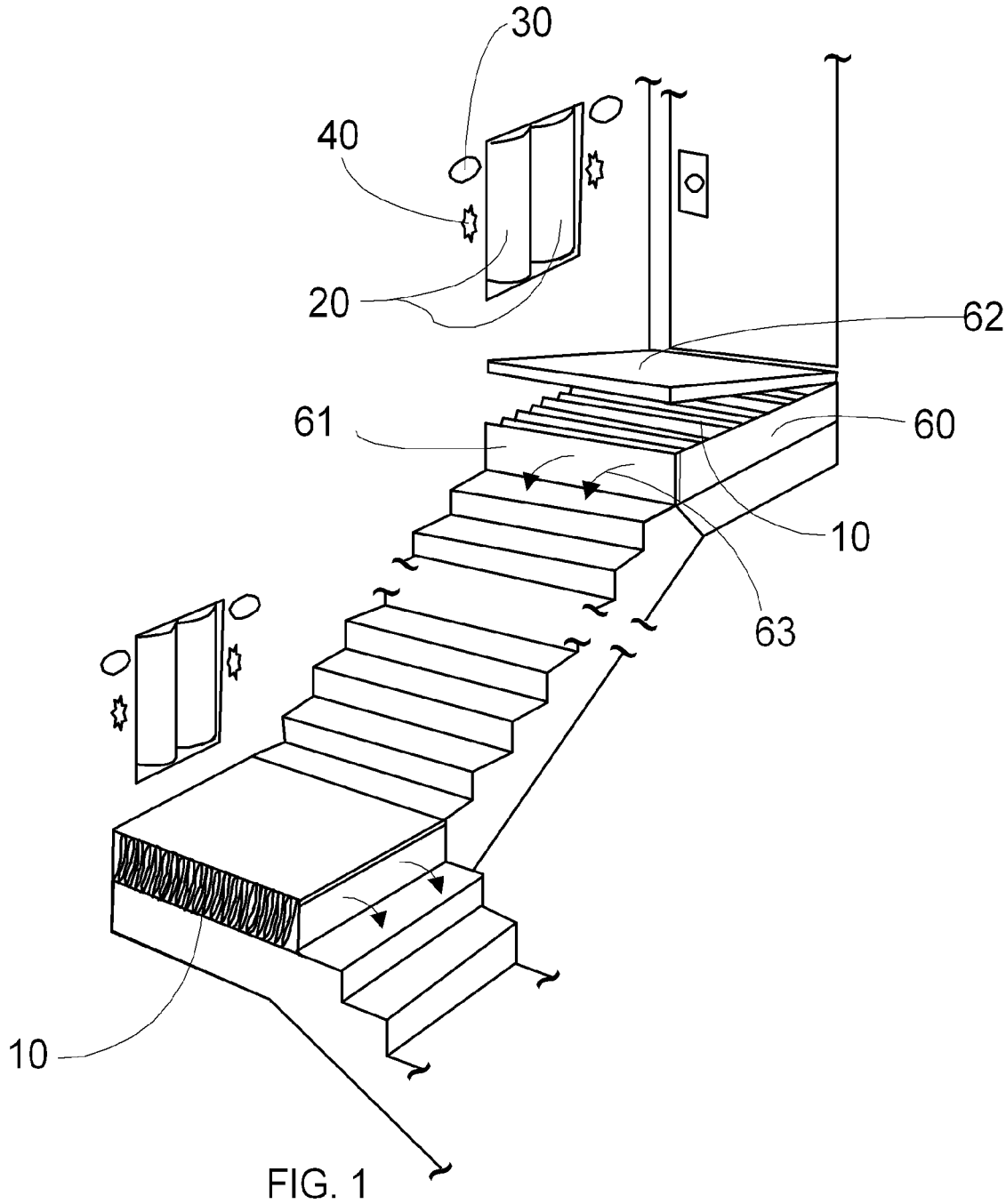
FIG. 1 is a perspective of an undeployed slide assembly integrated into a stairwell landing.

The Slide to Safety Emergency Evacuation device is inflatable slide to facilitate multi-storied building evacuation in the event of a fire or other emergency. The preferred embodiments and the primary alternatives are described herein and in the drawings.

The Slide to Safety Emergency Evacuation device as shown in FIG. 1 has three principle elements: an inflatable bag (10); a container (60) for the inflatable bag; and a pressurized gas source (20) to fill and deploy the bag.

In the preferred embodiment of the device, the Slide to Safety Emergency Evacuation device is unobtrusively built into each stair segment of the stairwell of the building in the manner discussed herein. A stair segment is generally considered to be composed of the steps between two landings in the stairwell.

In the preferred embodiment, the deployed width of the slide leaves part of the width of the staircase available for walking, for example by fire fighters and rescue personnel. In that embodiment, the bag has a width such that when inflated the bag covers only a portion of the width of the stairs. In other embodiments, the slide would occupy the entire width of the staircase.

The inflatable bag is made of flexible material that when uninflated, may be folded and compactly stowed in position in the container.

Figure 2:
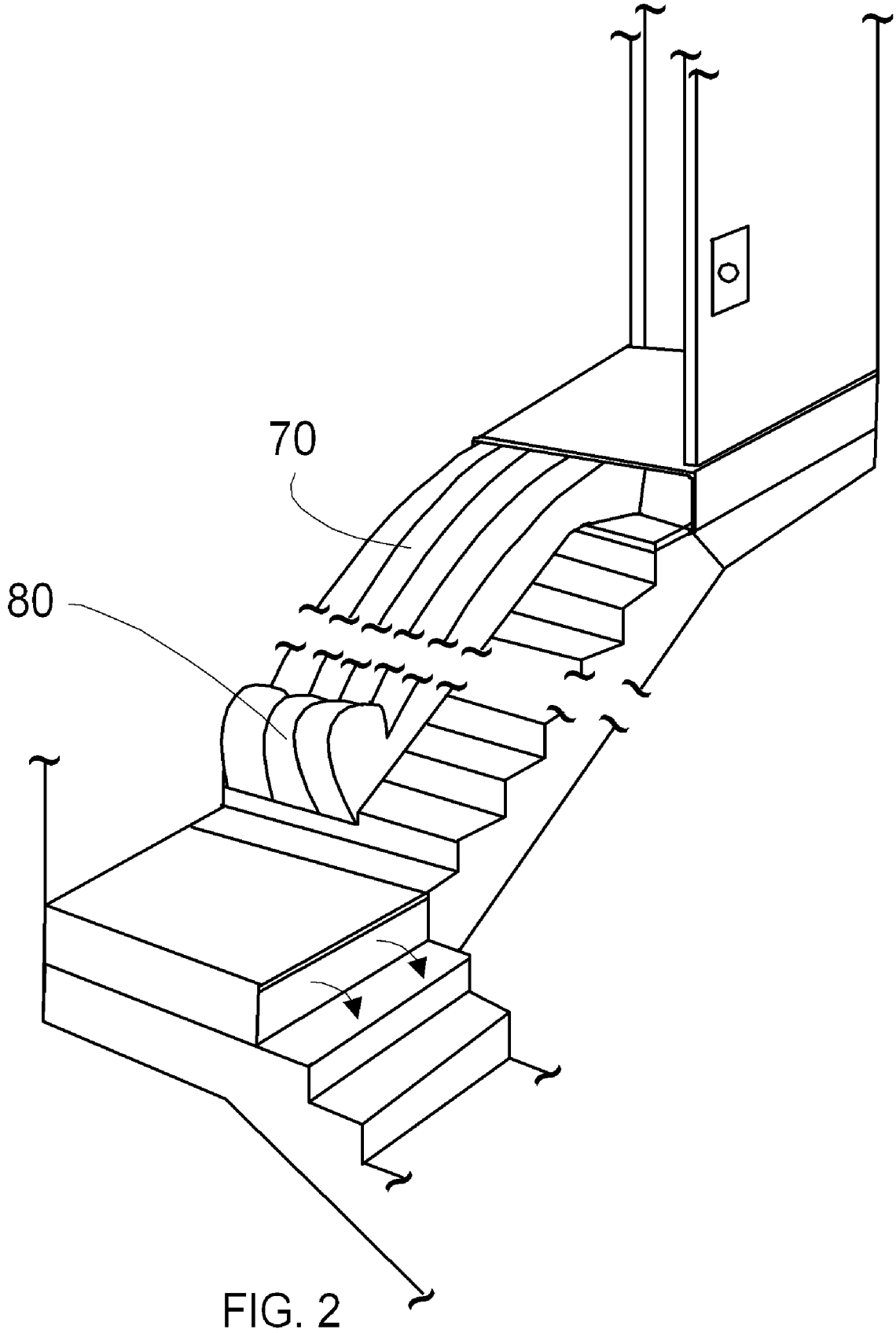
FIG. 2 is a perspective of a deployed slide assembly on a stair segment.

When a bag is inflated in the event of an emergency, each bag is deployed over one stair segment, as shown in FIG. 2. The inflated bag has a top surface (70) suitable for serving as a slide for people so that they can quickly and easily sit down and slide down to the next lower landing.

The bag has an airspace and structure so that it may be inflated to a sufficient pressure to permit people of varied sizes and abilities to slide without being discomforted by the top edges of the steps as they slide down.

The preferred embodiment of the inflated bag has a bulge or cushion (80) at the end of the slide to provide a means for gently stopping or limiting the speed of the user before the user accesses the slide on the next lower stair segment. This cushion is typically provided by an expanded chamber of air at the low end of the slide.

The second element of the Slide to Safety Emergency Evacuation device as shown in FIG. 1 is the container (60) for holding the inflatable bag (10) when not inflated and for releasing the bag for deployment over the stairs when the bag is inflated.

In the preferred embodiment, the wall (61) of the container facing the stairs is hinged to permit automatic opening of the container upon inflation of the bag as shown by the arrows (63).

In the preferred embodiment, the top wall (62) of the container is hinged to permit easy access for inspection of the folded slide. In alternative embodiments, the top wall is removable.

In the preferred embodiment, the container (60) with the folded bag (10) is modular in that it can be detached and removed by disconnecting a coupling to the pressurized gas source. A factory fresh replacement container with bag can then be dropped in and re-attached to the pressurized gas source with by the coupling. Such couplings are well known in the art and are typically quick disconnects or screw on connections.

In the preferred embodiment, the container is a sturdy metal box. In this embodiment, the container is located atop the landing and the container's top surface (62) becomes the new landing.

The third element of the Slide to Safety Emergency Evacuation device is the pressurized gas source pneumatically connected to the inflatable bag to permit inflation upon activation. The pressurized gas source is used to fill and deploy the inflatable bag. The pressurized gas source has controls to permit central activation or local activation of one or more pressurized gas sources at any stair landing.

In the preferred embodiment, the pressurized gas source is a centralized compressed air system plumbed to each inflatable bag. This system is backed up by one or more cylinders (20) of compressed air also plumbed to each inflatable bag. Each cylinder has a visible pressure gage (30) and a manual air release control valve (40) to activate the pressurized gas source to deploy the inflatable slide. Each pressure gage is visible to inspectors to assure that there is adequate gas pressure to eject the slide in an emergency. In the preferred embodiment, the valves are located behind a breakable glass to keep vandalism to a minimum.

In alternative embodiments, either the centralized compressed air system is used, or the cylinders are used.

In one embodiment of the method of the invention, the inflatable slide building evacuation device is deployed by manually activating the pressurized gas source, which inflates an inflatable bag and forms the slide surface on the stairs between landings. Then, a person slides to the next lower landing. Then, a person repeats the process until arriving at the landing serving the building exit.

In another embodiment of the method of the invention, the inflatable slide building evacuation device is used by activating the pressurized gas source for a one or more of stairs between landings; and evacuees slide down over the stairs having inflated bags.

The above-described embodiments including the drawings are examples of the invention and merely provide illustrations of the invention. Other embodiments will be obvious to those skilled in the art. Thus, the scope of the invention is determined by the appended claims and their legal equivalents rather than by the examples given.

What is claimed is:

1. A frameless inflatable slide for each stair segment above ground-level in a stairwell of a multi-storied building to enable building evacuation comprising, (a) an inflatable bag for each such stair segment, each said inflatable bag having a top surface suitable for serving as a slide for people once such inflatable bag is inflated over a stair segment, and each inflatable bag having an integral bulge at its end to serve as a cushion for stopping persons using the slide;

(b) a container storing each inflatable bag when not inflated and releasing the bag for deployment over said stairs; and, (c) a pressurized gas source pneumatically connected to the inflatable bag to permit inflation upon activation.

2. The inflatable slide building evacuation device of claim 1 wherein the inflatable bag comprises multiple air tubes connected together to provide cushioned and firm support for human body weight.

3. The inflatable slide building evacuation device of claim 1 wherein the inflatable bag has a width such that when inflated said bag covers only a portion of the width of the stairs.

4. The inflatable slide building evacuation device of claim 1 wherein the inflatable bag has a width such that when inflated said bag covers substantially all of the width of the stairs.

5. The inflatable slide building evacuation device of claim 1 wherein the inflatable bag is made of flexible material that when uninflated, may be folded and compactly stowed in position in the container.

6. The inflatable slide building evacuation device of claim 1 wherein the container includes a front flap that is hinged to drop down when the bag is inflated, so that the bag can exit the container and eject down the staircase.

7. The inflatable slide building evacuation device of claim 1 wherein the container and bag is a modular unit that can be replaced by disconnecting a coupling to the pressurized gas source.

8. The inflatable slide building evacuation device of claim 1 wherein the container has a hinged top to permit inspection of the inflatable bag.

9. The inflatable slide building evacuation device of claim 1 wherein the container has a top that is removable to permit inspection of the inflatable bag.

10. The inflatable slide building evacuation device of claim 1 further comprising controls to permit central activation or local activation of one or more pressurized gas sources at one or more stair landings.

11. The inflatable slide building evacuation device of claim 1 wherein the pressurized gas source comprises a central compressed air source plumbed to each inflatable bag.

12. The inflatable slide building evacuation device of claim 1 wherein the pressurized gas source comprises one or more compressed air-tanks, each having a visible pressure gage and a manual air release control valve.

13. The inflatable slide building evacuation device of claim 12 wherein the pressure gage and a manual air release control valve are located behind a breakable glass.

14. The inflatable slide building evacuation device of claim 1 wherein the inflatable bag in the container is accessible for inspection.

15. The inflatable slide building evacuation device of claim 1 wherein the container and bag are attached to the pressurized gas source with a coupling to facilitate easy removal and replacement.

16. A method of using the inflatable slide building evacuation device of claim 1 comprising the steps of, (a) manually activating the pressurized gas source to deploy a slide over the stairs between landings;

(b) sliding on the slide to the next lower landing; and, (c) repeating the process until arriving at the landing serving the building exit.

17. A method of using the inflatable slide building evacuation device of claim 1 comprising the steps of, activating the pressurized gas source for a one or more of stairs between landings; and, sliding on the slide over the stairs having inflated bags.

* * * * *